United States Patent [19]

Chapman et al.

[11] 4,121,925

[45] Oct. 24, 1978

[54] METHOD OF PRODUCING GREY CAST IRON BRAKE ROTORS WITH UNIFORM FRICTION AND WEAR CHARACTERISTICS

[75] Inventors: Barbara Jean Chapman, Chinley, by Stockport; Donald Hatch, Stockport, both of England

[73] Assignee: Ferodo Limited, Manchester, England

[21] Appl. No.: 823,707

[22] Filed: Aug. 11, 1977

Related U.S. Application Data

[63] Continuation of Ser. No. 534,097, Dec. 18, 1974, abandoned.

[30] Foreign Application Priority Data

Jan. 15, 1974 [GB] United Kingdom ..... 1861/74

[51] Int. Cl.[2] ..... C22C 33/08

[52] U.S. Cl. ..... 75/130 R; 75/123 CB; 148/35

[58] Field of Search ..... 75/123 CB, 123 J, 123 M, 75/130 R; 148/35

[56] References Cited

U.S. PATENT DOCUMENTS

| | | | |
|---|---|---|---|
| 3,042,512 | 7/1962 | Moore | 75/123 CB |
| 3,299,482 | 1/1967 | Tache et al. | 75/123 CB |
| 3,559,775 | 2/1971 | Miller | 75/123 CB |
| 3,591,366 | 7/1971 | Triches et al. | 75/123 CB |
| 3,673,004 | 6/1972 | Dumitrescu | 75/123 CB |
| 3,762,915 | 10/1973 | Heine | 75/123 CB |
| 3,909,252 | 9/1975 | Kuriyama et al. | 75/123 CB |

FOREIGN PATENT DOCUMENTS

| | | | |
|---|---|---|---|
| 44-12,263 | 6/1969 | Japan | 75/123 CB |
| 44-12,264 | 6/1969 | Japan | 148/35 |
| 361,216 | 9/1970 | U.S.S.R. | 75/123 CB |
| 475,410 | 12/1975 | U.S.S.R. | 75/123 CB |

OTHER PUBLICATIONS

Cast Metals Handbook, AFS, 1944, pp. 560, 564, 569–571, 573, 578, 579, 582, 583.

"Constituent Elements in Steel and Cast Iron," Shieldalloy Corp., Jan. 1944, pp. 75–76.

*Primary Examiner*—Arthur J. Steiner

*Attorney, Agent, or Firm*—Stevens, Davis, Miller & Mosher

[57] ABSTRACT

The friction characteristics and wear rate of grey cast iron are controlled within pre-determined limits by controlling the content in the cast iron of an element which is capable of forming in the cast iron hard high melting discrete particles.

4 Claims, 3 Drawing Figures

Figure 1:
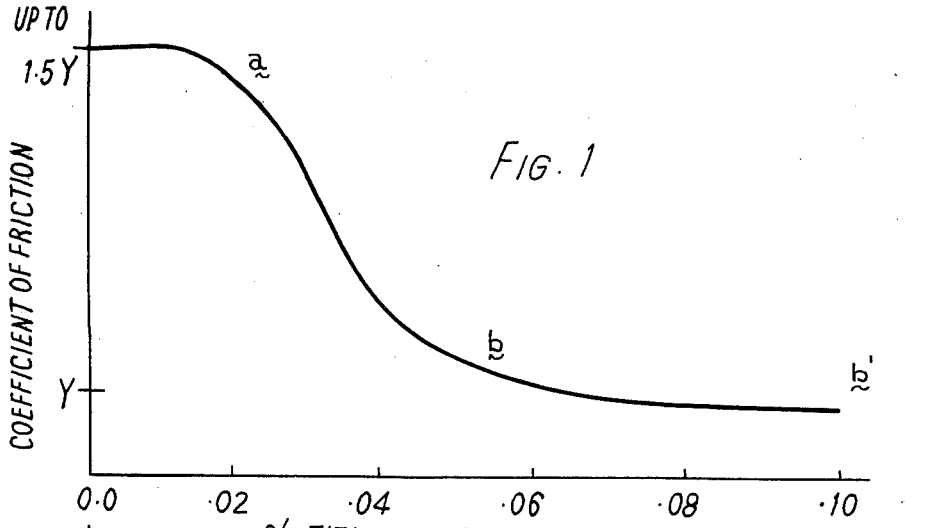

METHOD OF PRODUCING GREY CAST IRON BRAKE ROTORS WITH UNIFORM FRICTION AND WEAR CHARACTERISTICS

This is a continuation of application Ser. No. 534,097 filed Dec. 18, 1974, now abandoned.

This invention concerns improvements in or relating to vehicle brakes.

It is known that the friction characteristics of the materials used in the components of braking systems can vary greatly, with consequent loss of the desired braking effects, even between batches of materials of nominally the same characteristics. For example, the composition of a friction lining material for disc brake pads or drum brake shoes must be strictly controlled if the desired wear rate and friction coefficients are to be attained. Variation also occurs in these characteristics of the 'counter-member', that is, for example, the brake disc or drum itself, usually formed from grey flake graphite cast iron, even if the material is notionally of the same composition. We have found that the variation of the friction characteristics of such cast iron counter-member is due, surprisingly, to variation in content therein of relatively minute quantities of impurities.

According to the present invention, a method of controlling the friction characteristics and wear rate of grey cast iron comprises controlling the content in the cast iron of an element (other than iron or silicon) which is capable of forming therein hard, high melting discrete particles.

The elements which are primarily responsible for the variation in friction characteristics and wear rate include the metals titanium, vanadium and niobium; other elements such as tungsten apparently do not exhibit this effect, because it is believed that they do not separate out as discrete carbide particles.

Thus, by controlling the content of such an element, (and hence of the aforesaid particles) in the cast iron, it is possible to reduce the degree of variation in the friction characteristics of counter-members formed from the cast iron. The said metal (s) will not normally be present in an amount exceeding 0.15% by weight.

The metal primarily responsible for variation in friction characteristics is titanium, which forms a hard high melting carbide, or so-called titanium carbonitride complex, which is normally insoluble in the iron matrix. Titanium is nearly always present as an impurity in cast iron, up to a level of about 0.1 percent; we have determined that variation of the titanium content, and/or of the vanadium and/or niobium content, within this relatively narrow range can result in significant differences in the friction characteristics of counter-members otherwise notionally of identical composition.

Grey flake graphite cast iron has always been assumed to be consistent in terms of its friction characteristics, and hence attention has been directed for many years to 'external' causes for the variation in the friction characteristics, and it has been thought that the thickness of the metal counter-member, the cooling effect of the adjacent metal structures and other external factors, have been responsible for the variation. The graphite flake size in the cast iron has been found to have little or no effect on the normal friction and wear characteristics of brake rotors, and therefore, it is all the more surprising that variation of such minute quantities of titanium, vanadium and/or niobium should give such variation in the friction characteristics of grey cast iron. The effects of other variations which normally occur between grey cast iron compositions used for counter-members (brake rotors), such as the phosphide content, matrix-hardness, etc., in addition to the graphite flake structure, which might affect the friction and wear properties are, surprisingly, substantially overridden by the effect of the very hard discrete particles.

Controlling the total content of such elements as titanium, vanadium and/or niobium to below 0.015% ensures that the friction and wear of friction material conventionally used in braking of road vehicles will each be consistently at the high end of the range normal for that material, and controlling the total content thereof to more than 0.075% ensures that the friction and wear will be consistently at the low end of the range normally given by each individual material. The upper limit will normally be below the level which would cause major structural changes in the cast iron. It is not possible to specify an exact limit because although, in general, one would avoid having more than 0.15% of any of these elements present, by making suitable adjustments to the formulation of the cast iron it is possible to accomodate more than this amount without deviating from a grey cast iron structure.

It will be appreciated that the terms 'high' and 'low' are used in a relative sense: it is necessary to select standard conditions for determination of the friction characteristics of the counter-member. That is, normal operating conditions, a standard friction lining material and fixed braking pressure should be selected when the friction characteristics are to be determined. Under these conditions, a 'high' friction coefficient may be as much as 50% greater than 'low' friction coefficient.

The content of the element capable of forming a hard high melting carbide (or complex thereof) may be determined by any known metallurgical method; for example, the titantium content may be determined spectrographically during standard quality control testing of the melt, for example, when the silicon content is determined in order to check the chill characteristics of the cast iron.

The content of the metal forming the hard discrete particles may be altered to the desired control value, as necessary, by normal metallurgical techniques, for example, the titanium content may be increased by adding titanium, in the form of ferro-titanium, to the melt.

Although titanium is the element found to vary normally in cast iron, due to the differing amounts present in the raw materials used, other elements not normally present in significant amounts can be added. Any elements which will produce very hard discrete particles can be used, such as the vanadium or niobium referred to. For example, in a highly preferred aspect, vanadium (in the form of ferro-vanadium) is added to a cast iron melt to control the friction characteristics and wear rate; that is the content of the titanium in the cast iron melt is "topped up" by using vanadium as an additive.

The Examples set out in the Table, hereafter, illustrate preferred embodiments of the invention. In the Table, the balance to 100% of the grey cast iron compositions quoted is, of course iron. Examples V and VII illustrate the effect obtained by adding a controlled amount of vanadium to the cast iron of Example I, and Example VIII shows the effect of adding a controlled amount of titanium to the cast iron of Example II (the addition of these controlled amounts was effected by standard metallurgical techniques). The remaining Examples can be used to illustrate the effect of gradually increasing titanium content in a controlled manner in different grey cast iron compositions.

TABLE

| Composition (%) and Properties | Example I | II | III | IV | V | VI | VII | VIII | IX |
|---|---|---|---|---|---|---|---|---|---|
| Carbon | 3.20 | 3.32 | 3.28 | 3.42 | 3.20 | 3.60 | 3.20 | 3.32 | 3.30 |
| Silicon | 2.15 | 1.77 | 1.95 | 2.23 | 2.15 | 2.00 | 2.15 | 1.77 | 2.10 |
| Manganese | 0.62 | 0.56 | 0.81 | 0.60 | 0.62 | 0.75 | 0.62 | 0.56 | 0.65 |
| Sulphur | 0.06 | 0.07 | 0.03 | 0.103 | 0.06 | 0.035 | 0.06 | 0.07 | 0.03 |
| Phosphorus | 0.075 | 0.11 | 0.058 | 0.06 | 0.075 | 0.010 | 0.075 | 0.11 | 1.30 |
| Titanium | 0.012 | 0.014 | 0.018 | 0.029 | 0.012 | 0.053 | 0.012 | 0.092 | 0.107 |
| Vanadium | — | — | — | — | 0.027 | — | 0.048 | — | — |
| Friction (Material A) | 0.48 | 0.53 | 0.43 | 0.40 | 0.38 | 0.41 | 0.34 | 0.38 | 0.38 |
| Material Wear (Material A) | 22.0 | 26.1 | 16.1 | 11.2 | 12.3 | 9.5 | 11.2 | 8.5 | 7.6 |
| Disc Wear (Material A) | 1.2 | 2.0 | 0.9 | 0.5 | 0.9 | 0.4 | 0.30 | 0.2 | 0.4 |
| Friction (Material B) | — | 0.52 | 0.48 | 0.44 | 0.48 | 0.40 | 0.38 | — | 0.39 |
| Material Wear (Material B) | — | 35.8 | 34.2 | 37.4 | 38.5 | 26.4 | 32.6 | — | 19.4 |
| Disc Wear (Material B) | — | 2.5 | 2.2 | 1.9 | 2.10 | 1.1 | 1.50 | — | 0.4 |

Material wear = loss in thickness of each disc pad, in thousandths of an inch.
Disc wear = total loss in thickness of each disc, in thousandths of an inch.

The Table shows these effects when brake discs manufactured from the cast irons were tested against one or both of two types of standard quality, commercially available, disc brake pads, referred to hereafter as Material A and Material B. The test procedure will now be described.

TEST PROCEDURE

Full sized (Girling 16P) disc brake pads were fitted into a conventional (Girling type 16P) brake assembly, using the appropriate (Fort Cortina) size discs, and mounted on an inertia dynamometer of 700 lbs ft$^2$ (29.5 Kg. m$^2$). A new set of brake pads was used for each test and the discs were freshly ground before each test.

The test consisted of seven temperature controlled circuits each of 200 brake applications and 3 hours duration, designed to simulate typical road running of a passenger car. The application speed, release speed, pressure and temperature were combined in randomised but reproducible sequences to give a spectrum of energies each representative of different duty levels encountered in normal road usage of passenger cars.

Hydraulic pressures of 200 and 300 psi (1.38 and 2.07 MN/m$^2$), and application speeds up to 70 mph (112.65 Km/h) were employed. Thus the highest energy application would be braking from 70 mph (112.65 Km/h) to rest and the lowest from 40 to 35 mph (64.37 to 56.33 Km/h).

The seven circuits consisted of two circuits designed to simulate light duty running, two to simulate moderate duty and two to simulate heavy duty running followed by a final moderate duty circuit. The temperatures were controlled to cover the ranges shown below:

| | | |
|---|---|---|
| Light Duty | 70° C - 140° C | Average 100° C |
| Moderate Duty | 90° C - 210° C | Average 150° C |
| Heavy Duty | 150° C - 300° C | Average 210° C |

Friction was measured for every brake application and plotted automatically against temperature. The figure quoted in the Examples is the average friction recorded at 150° C. on the final moderate duty circuit.

Each pad was measured at 4 points using a digital micrometer, reading to 0.0001 in. (0.0025 mm). The discs were measured with a similar micrometer at 16 points situated round the disc at a distance of ¾ in. (19 mm) from the outer perimeter. The figures quoted with the Examples are the total thickness losses incurred during the full 7 circuits.

Figure 2:
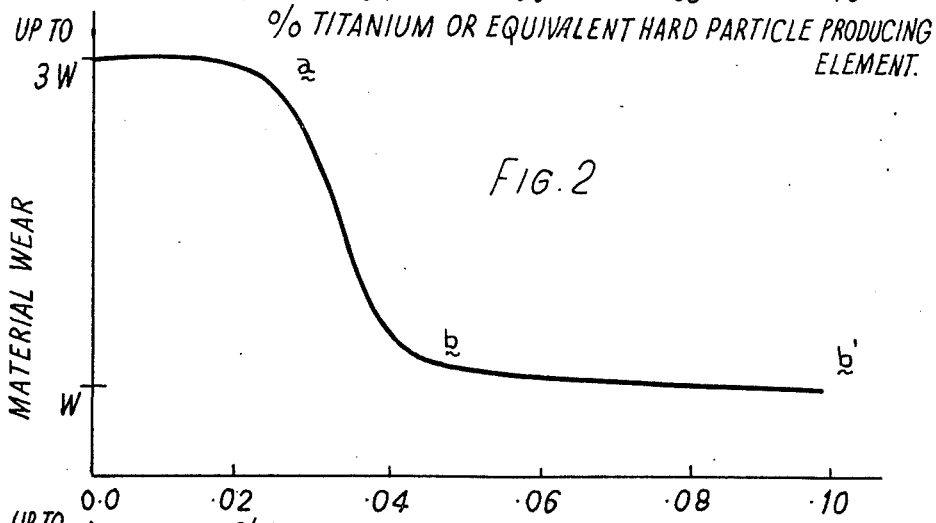
Figure 3:
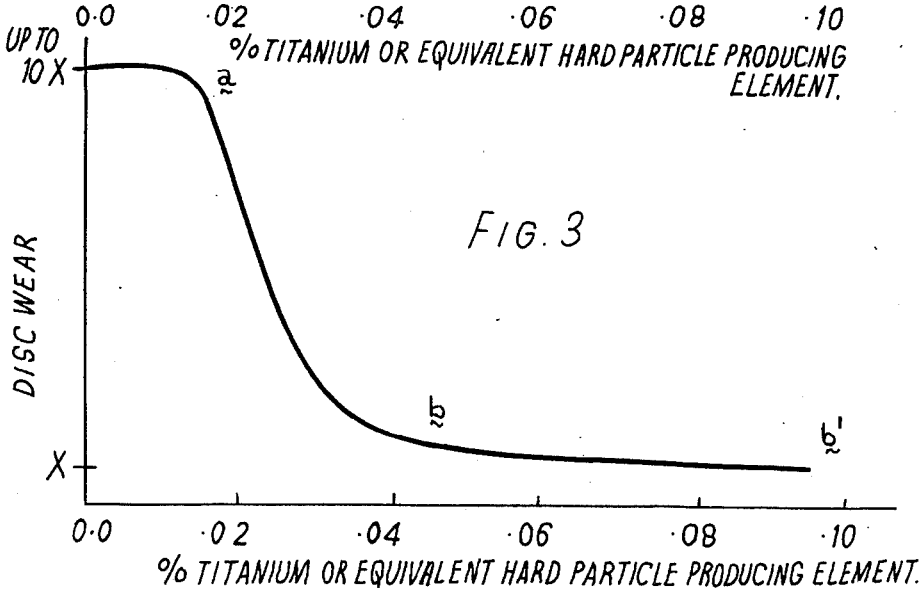

The results can be summarized diagrammatically as shown in the accompanying drawings, wherein FIG. 1 is a graph of coefficient of friction plotted against the content of the metal forming hard, high melting discrete particles;

FIG. 2 is a graph of friction material wear plotted against the content of said metal; and FIG. 3 is a graph of disc (cast iron) wear plotted against the content of said metal.

It can be seen that by controlling the titanium or titanium plus vanadium (or other said metal or mixed metal systems) content within the range 0–*s*, high friction coefficients (and high wear rate) are obtained; by controlling titanium content within the range $b$–$b^1$, low friction coefficients (and low wear rate) are obtained. It is, of course, possible to control the titanium or similar metal content within the range *a*–*b* to obtain an intermediate coefficient of friction, but the steepness of the curve in this region will normally mean that the degree of control of the friction characteristics is not as accurate.

The position of *a* and *b* vary according to the friction material used. With Material A, *a* is at 0.015% titanium and *b* is at 0.04%, whereas with Material B, *a* is at 0.02% titanium and *b* is at 0.065%. It will be clearly seen from the graphs that the invention provides the possibility of accurately controlling the friction characteristics of cast iron (for the first time, so far as we are aware), leading to the provision of a method of ensuring reproducibility of these characteristics from batch to batch of the cast iron. By virtue of the invention, it is now possible to obviate differences arising in the characteristics between counter-members on one vehicle, or between vehicles of any particular make, by ensuring that the content of titanium or similar metal in the batch of cast iron is at the desired level, and if necessary by controlling that content to the desired level. The titanium or similar metal content is easily increased, as described above, but reduction of its content in a foundry is rather difficult, requiring dilution of the basic cast iron material with ferrous material having a low content of said metal.

Other commercially available friction materials give results comparable to those obtained for the commercial friction materials described above.

We claim:

1. In a method of producing grey cast iron brake rotors, having a predetermined coefficient of friction and wear rate, the improvement which comprises the steps of:

(i) determining the total content in a grey cast iron melt of the metals titanium, vanadium, niobium and mixtures thereof;

(ii) determining the total content of said metals in said melt which will result in a desired coefficient friction and wear rate in a grey cast iron rotor cast from said melt and;

(iii) adjusting the total content of said metals in said melt to the level determined in (ii) which will result in said desired coefficient of friction and wear rate on casting of the melt, said adjusted total content being below 0.15% by weight.

2. The method according to claim 1 wherein the total content of said metals in said melt determined in step (ii) is a content within the range of about 0.015 to about 0.075% by weight.

3. The method according to claim 1 wherein the total content of said metals in said melt in step (ii) which results in a desired coefficient of friction and wear rate is 0.075% to 0.15% by weight.

4. The method according to claim 1 wherein the total content of said metals in said melt in step (ii) which results in a desired coefficient of friction and wear rate is less than 0.015%.

* * * * *